United States Patent [19]

Eliasson et al.

[11] Patent Number: 4,734,105

[45] Date of Patent: Mar. 29, 1988

[54] PROCESS AND DEVICE FOR THE REMOVAL OF SOLID OR LIQUID PARTICLES IN SUSPENSION FROM A GAS STREAM BY MEANS OF AN ELECTRIC FIELD

[75] Inventors: Baldur Eliasson, Birmenstorf; Marcel Escudier, Mönthal; Michael Hirth, Unterentfelden; Jakob Keller, Dottikon, all of Switzerland

[73] Assignee: BBC Brown, Boveri & Company Limited, Baden, Switzerland

[21] Appl. No.: 809,787

[22] Filed: Dec. 17, 1985

[30] Foreign Application Priority Data

Dec. 21, 1984 [CH] Switzerland ..... 6130/84

[51] Int. Cl.[4] ..... B03C 3/08; B03C 3/01; B03C 3/41

[52] U.S. Cl. ..... 55/5; 55/2; 55/6; 55/126; 55/128; 55/136; 55/137; 55/150; 55/151; 55/152; 55/338; 55/340

[58] Field of Search ..... 55/6, 2, 124, 128, 129, 55/136, 138, 152, 5, DIG. 25, 126, 137, 150, 151, 338, 340; 361/225, 226, 229, 230, 231

[56] References Cited

U.S. PATENT DOCUMENTS

| | | | |
|---|---|---|---|
| 2,700,429 | 1/1955 | Wintermute | 55/152 X |
| 2,758,666 | 8/1956 | Prentiss | 55/124 X |
| 3,470,417 | 9/1969 | Gibbons | 361/225 X |
| 3,496,701 | 2/1970 | Berg | 55/6 |
| 3,717,977 | 2/1973 | Stone | 55/128 X |
| 3,777,214 | 12/1973 | Taylor et al. | 361/230 X |
| 3,826,063 | 7/1974 | Festner | 55/136 X |
| 4,038,583 | 7/1977 | Breton | 361/230 |

FOREIGN PATENT DOCUMENTS

| | | | |
|---|---|---|---|
| WO84/04052 | 10/1984 | PCT Int'l Appl. | 55/2 |
| 799625 | 8/1958 | United Kingdom | 55/128 |
| 567499 | 8/1977 | U.S.S.R. | 55/138 |
| 962653 | 10/1982 | U.S.S.R. | 55/152 |

*Primary Examiner*—Kathleen J. Prunner

*Attorney, Agent, or Firm*—Oblon, Fisher, Spivak, McClelland & Maier

[57] ABSTRACT

A method and device for removing solid or liquid particles contained in suspension in a gas stream by an electric field, wherein the gas stream flow is directed past ion sources which simultaneously act as field electrodes. The suspended particles are thereby changed in a bipolar manner, such that approximately half of the particles are positively charged and the other half negatively charged, and are forced by the electric field to migrate across the gas stream into a preferred neutralization zone where they are concentrated, discharged, partially agglomerated and coagulated. Subsequently, the particle-enriched and particle-depleted partial gas stream thus formed are separated and treated further in accordance with operating requirements. Thereby the remaining gas stream maximally loaded with particles is fed into a particle-removal device where their withdrawal occurs. The device results in a considerable reduction in the gas volume carried along up to the fine-cleaning stage, and a decrease in cost of the electrofilter by a factor of two or more.

27 Claims, 18 Drawing Figures

PROCESS AND DEVICE FOR THE REMOVAL OF SOLID OR LIQUID PARTICLES IN SUSPENSION FROM A GAS STREAM BY MEANS OF AN ELECTRIC FIELD

BACKGROUND OF THE INVENTION

1. Field of the Invention

This invention relates to a process and a device for the removal of solid or liquid particles contained in suspension in a gas flow.

2. Discussion of the Background

Devices for the removal of particulate matter from gas flows with the aid of electric fields (so-called electrofilters) are well-known in a variety of different forms. They are all based on the principle that the particles suspended in the gas flow are first in some way charged electrostatically in a unipolar manner (usually according to the principle of the corona effect), in order to be then attracted to the oppositely charged electrode (collecting electrode) and retained there. The final removal (withdrawal) of the particle layer deposited on the collecting electrode usually occurs periodically in a mechanical manner by rapping or vibrating the collecting electrode which is usually plateshaped. (cf. Leuger, *Lexikon der Technik*, Vol. 6, Energietechnik und Kraftmaschinen, key word "electrofilter", pp. 286–282 Stuttgart, 1965).

The continued development of electrofilters has led to numerous refinements of the device and modes of operation which have resulted to a certain extent in rather complicated and costly designs. Mention can be made here of the spatial and functional separation of the ionization source and the electric field for particle separation, use of additional electrodes (cf. DE-PS No. 24 38 670 and DE-OS No. 27 44 556), particle agglomeration (e.g. DD-PS No. 144 509; EP-A No. 0 009 857), pulsed electric fields (DE-OS No. 3 004 474 A1), installation of meshes in front of the collecting electrode (JP-Pat. No. 56-136668), alternating voltage operation with an insulating screen for the purpose of increasing the breakdown voltage (DE-OS No. 3 039 639), combination of electrofilters and cyclones (DE-OS No. 3 235 953 A1).

Despite the above-mentioned refinements and the resulting partial improvements, the conventional processes and devices for particle removal by means of electric fields leave much to be desired. Electrofilters are bulky and seldom possess the desired optimum efficiency. During rapping and vibrating of the collecting electrodes, part of the particles already separated are stirred up again and reentrained into the gas stream. The particle layer already deposited on the electrode is charged, whereby electrical breakdown with "back corona effects" can occur, and a fraction of the particles is thrown back into the gas stream. Further, the electric field strength, which is the determining factor in the separation of the particles, is limited since the breakdown voltage resulting from an inhomogeneous field distribution is considerably less than that for a homogeneous field. All these factors lead to a decrease in the filter efficiency and to a deterioration of particle separation.

Thus there is a great need to improve, refine, and reduce the cost of conventional electrofilter technology.

SUMMARY OF THE INVENTION

Therefore, it is an object of the present invention to provide a process and a device for the removal by means of electric fields of solid or liquid particles suspended in a gas flow, whereby the electric field strength, which is a determining factor for the charging and migration of the particles and necessary for quick and efficient particle separation, can be increased considerably without having to take into account the usual limitations set by the corona voltage of the electrodes. At the same time, both the ionization of the gas stream and the removal of the material particles should become simpler and more efficient, whilst avoiding side effects, such as the stirring up of particles already separated, disruption through electrical breakdown, influences of conductivity of the particles, etc. It is another object of the present invention to reduce drastically the expenditure for electrofilters both from a cost and volume point of view.

These and other objects are achieved according to the invention by providing a new and improved method and device for the removal of solid or liquid particles in suspension in a gas stream by means of an electric field, wherein a means for guiding the gas stream past sources of electrically charged elementary particles is provided such that the suspended particles are charged in a bipolar manner approximately half positively and the the other half negatively. The charged particles are forced across an electric field generated transverse to the flow direction into a migration zone due to a transverse migration, and thus concentrate in a neutralization zone. There, with the aid of the electric field, the charged particles agglomerate and coagulate with a simultaneous corresponding at least partial reduction of their charges, whereby both particle-enriched and particle-depleted partial gas streams are formed, which are subsequently separated from each other.

The basic principle of the invention consists of the fact that, through complete spatial and functional separation of the region necessary for the generation of ions (ionization region) needed to charge the particles, from the actual migration and concentration region of the charged particles (separation region), it is possible to achieve high homogeneous electric fields to increase particle migration velocity transverse to the flow direction. Thereby the necessary filtration path in the flow direction is shortened considerably. Furthermore, as a result of bipolar charging, oppositely charged particles are forced to migrate in opposite directions and thereby concentrate, neutralize, agglomerate and coagulate in a preferred zone of the gas phase. The gas stream thus enriched with particles can be separated off and with simple subsequently added means the particles can be withdrawn completely at a fraction of the expenditure necessary for conventional filters.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
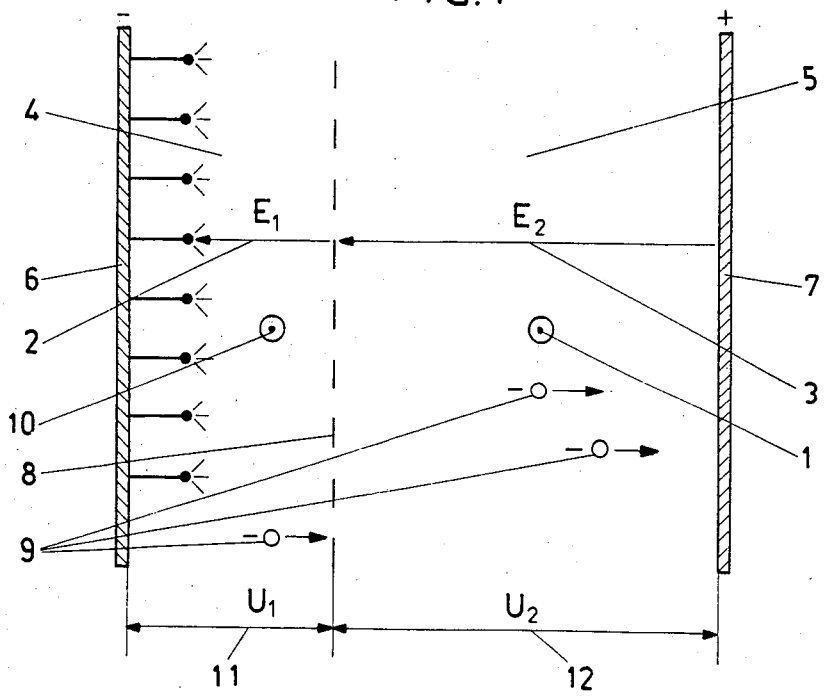
FIG. 1 is a schematic representation of the electrode and field configurations of an electrofilter with separated ionization and separation regions achieved by division with a mesh-like supplementary electrode.

Referring now to the drawings, wherein like reference numerals designate identical or corresponding parts throughout the several views, FIG. 1 shows a schematic representation of the electrodes and the electric-field configuration of an electrofilter with separated and independent ionization and separation regions. Reference numeral 1 designates the gas stream, normal to the drawing, directed towards the observer (vector representation) which is loaded with particles in suspension (untreated gas stream). Reference numeral 2 designates the electric field used for the ionization of the gas (vector representation as ionization field strength $E_1$), whilst reference 3 refers to the electric field necessary for the separation and migration of the particles (vector representation as separation field strength $E_2$). Reference numeral 4 represents the ionization region formed by $E_1$, and numeral 5 designates the separation region for charged particles formed by $E_2$. Numeral 6 designates the negative corona electrode generally of needles and/or wires for the generation of the corona effect, and numeral 7 designates the positive separation electrode usually in the form of a plate. The space located between electrodes 6 and 7 is split into regions 4 and 5 by a supplementary electrode 8 in the form of a mesh, grid, etc. Reference numeral 9 designates a particle negatively charged by ions which migrates from the supplementary electrode 8 to the positive separation electrode 7 (indicated by arrows) where it is deposited. Reference numeral 10 indicates a stream of supplementary gas directed towards the observer (vector representation) for improving ionization in the ionization region 4. This supplementary gas 10 is to be understood as being optional. Reference numerals 11 and 12 designate the electrical voltages $U_1$ and $U_2$ corresponding to the field strengths of electric fields 2 ($E_1$) and 3 ($E_2$).

Of course, the polarities of the electrodes 6 and 7 could be reversed, i.e., corona electrode 6 positive, separation electrode 7 negative.

Figure 2:
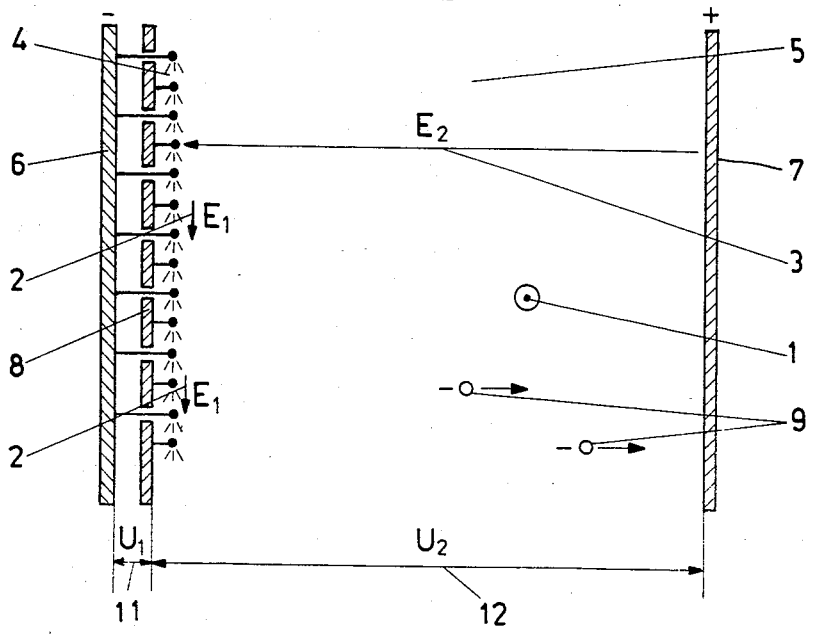
FIG. 2 is a schematic representation of an electrofilter with separated ionization and separation regions using identical corona electrodes in the ionization region.

FIG. 2 represents the electrodes and the electric field configuration of an electrofilter with separated ionization and separation regions where corona electrodes of the same type are used in the ionization region. Here the supplementary electrode 8 is recessed practically to the plane of the negative corona electrode 6. In the same way as corona electrode 6, supplementary electrode 8 is provided with elements with a small radius of curvature (points, wires) for release of the electric charge. These points or wires for 6 and 8 are preferably located at the same level. The corresponding electric field 2 (vector $E_1$) then aligns itself normal to electric field 3 (separation field strength $E_2$). In the present case the actual corona electrodes 6 and 8 have elements with the same radius of curvature. All other reference numbers and symbols correspond geometrically and functionally to those in FIG. 1.

Figure 3:
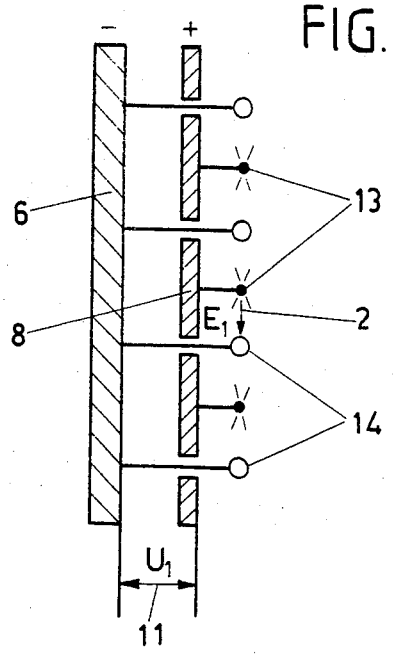
FIG. 3 is a schematic representation of a part of an electrofilter with separated ionization and separation regions with ionization electrodes of two different types in the ionization region.

FIG. 3 is a schematic representation of a part of an electrofilter with separated ionization and separation regions where ionization electrodes of two different types are used in the ionization region. The separation electrode and the separation region are not shown. Electrode 6 is shown here with elements having a large radius of curvature, electrode 8 with those having a smaller radius of curvature. These elements electrodes 6 and 8, which are actually needle- or wire-shaped, are indicated by numerals 14 and 13 respectively. Of course, both the polarity and the respective radii of curvature of electrodes 13 and 14 can be interchanged, when positive or negative charge, corresponding to the corona effect, is accordingly generated on the more pointed electrode. The rest of the reference numbers and symbols correspond to those in FIG. 2.

Figure 4:
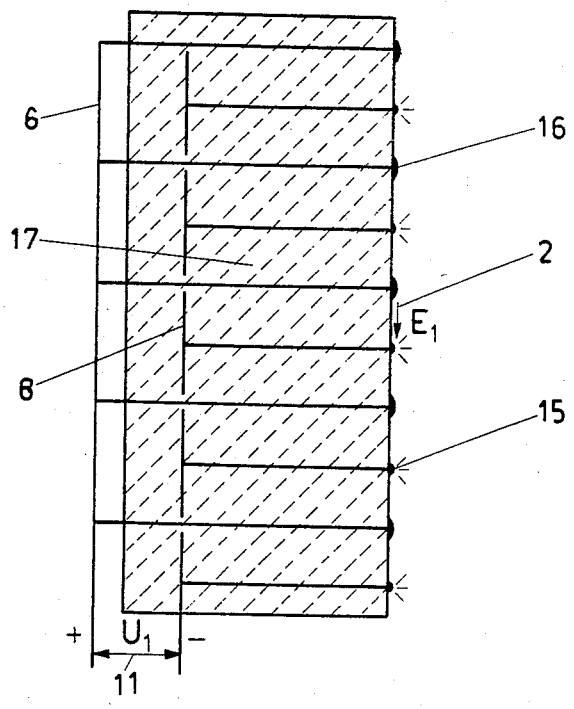
FIG. 4 is a schematic representation of a part of an electrofilter with separated ionization and separation regions using cap-shaped ionization electrodes embedded in an insulating body in the ionization region.

FIG. 4 is a schematic representation of a part of an electrofilter with sepearated ionization and separation regions with cap-shaped electrodes having leads embedded in an insulating body. In this embodiment, the electrodes 6 and 8, similar to those in FIGS. 2 and 3 are provided. Also provided is the insulating body 17 in which the leads to the actual discharge electrodes 15 and 16 are embedded. Some of these cap-shaped electrodes located on the surface of the insulating body 17 have a small (15), others a large (16), radius of curvature. The same is valid regarding the polarity of electrodes 15 and 16 and of electrodes 6 and 8, respectively, as shown in FIG. 3.

Figure 5:
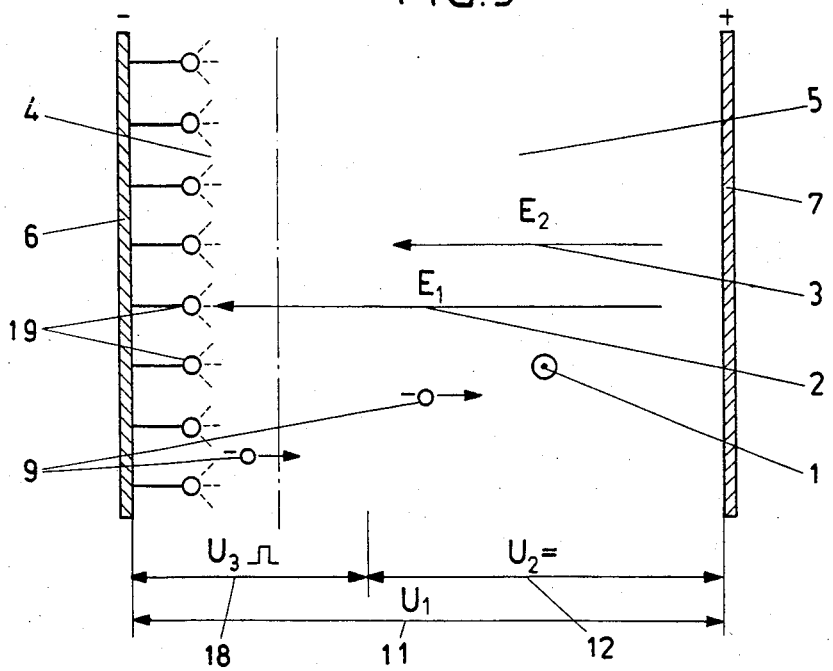
FIG. 5 is a schematic representation of an electrofilter with separated ionization and separation regions using superimposed electric fields by means of a pulsed voltage.

FIG. 5 is a schematic representation of an electrofilter with separated ionization and separation regions where a superposition by means of a pulsed voltage is used for the electric fields. The separation voltage 12 is given by a direct voltage $U_2$=. A variable supplementary voltage 18 (pulsed voltage $U_3$) is used for the generation of the field strength 2 (vector $E_1$) which varies in a periodic manner in the ionization region 4. This supplementary voltage 18 is superimposed on the direct voltage 12 and results in a periodically varying ionization voltage 11 (corona voltage $U_1$). The actual ionization region 4 is virtually split off from the separation region 5 by the dot-dash line. Ionization is initiated at the electrodes 19 which are needle- or wire-shaped 19 for intermittent corona effect, and which are provided with the appropriate radius of curvature for this purpose. All remaining reference numbers and symbols correspond to those in the previous figures.

Figure 6:
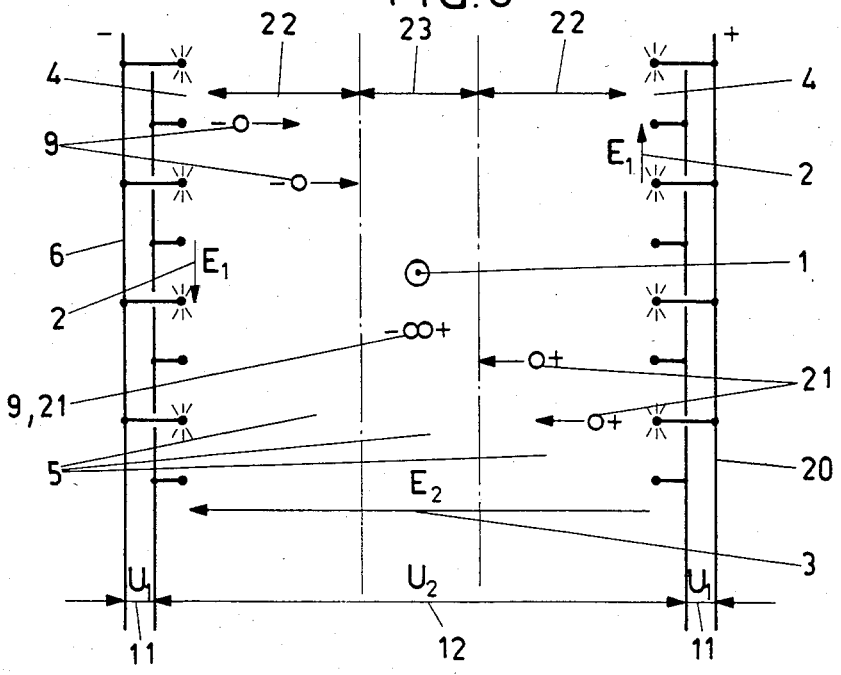
FIG. 6 is a schematic representation of an electrofilter with positive and negative ionization regions and with a neutralization zone in between, but with no separation electrode.

FIG. 6 is a schematic representation of an electrofilter which has both a positive and a negative ionization region and in between a neutralization zone but no actual separation electrode. Basically the electrofilter consists of two symmetrically opposed devices according to FIG. 3, whereby the one device has exactly the opposite polarity electrode as the other. There is no separation electrode. Reference numeral 20 designates a positive corona electrode which is an analogous manner to the negative corona electrode 6 is provided with needles or wires. The particles 21 become positively charged on one side and the particles 9 negatively charged on the other. At the side of each ionization region 4 is a corresponding migration zone 22 for the charged particles. In between there is a neutralization zone 23 where the particles can be discharged and where in addition agglomeration or coagulation can occur. Such a neutral particle consisting of a negative and a positive part is designated by the symbol 9/21. For the remaining reference numbers and symbols see the previous figures.

Figure 7:
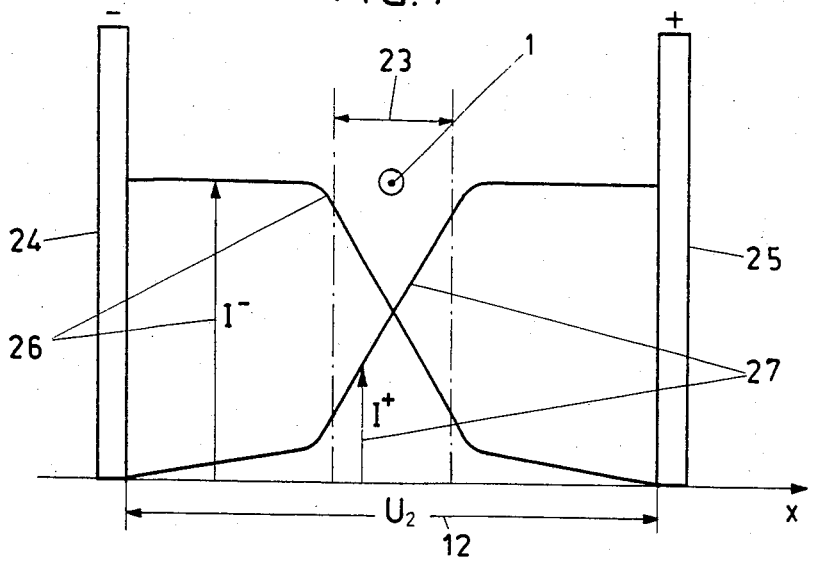
FIG. 7 is a diagram of the distribution of the ion currents between symmetrically arranged bipolar ion sources with a neutralization zone in between and no separation electrode.

FIG. 7 shows a diagram of the distribution of the ion currents in the electric-field space between a symmetrical arrangement of bipolar ion sources and the intervening neutralization zone according to the device shown in FIG. 6. The electrodes and their ionization regions represented in detail in FIG. 6 are shown here schematically in block form. Numeral 24 represents in a general way a negative ion source, which also acts as the negative field electrode, numeral 25 represents the corresponding positive ion source, also acting as the positive field electrode. Numeral 26 represents the distribution of the negative ion current (measured as arrow $I^-$), 27 that of the positive ion current (measured as arrow $I^+$) along the x-axis normal to the ion sources 24 and 25 which are assumed to be plates. The ion currents 26 and 27 are also a measure for the corresponding streams of negatively and positively charged particles. In the vicinity of the ion sources (field electrodes) 24 and 25 both distributions reach a maximum and then fall within the neutralization zone 23 due to the mutual, successive discharge of the particles. This results in the concentration and, under certain favorable conditions, also in the coagulation and agglomeration of the now discharged particles in the neutralization zone 23. The remaining reference numbers and symbols correspond to those in FIG. 6.

Figure 8:
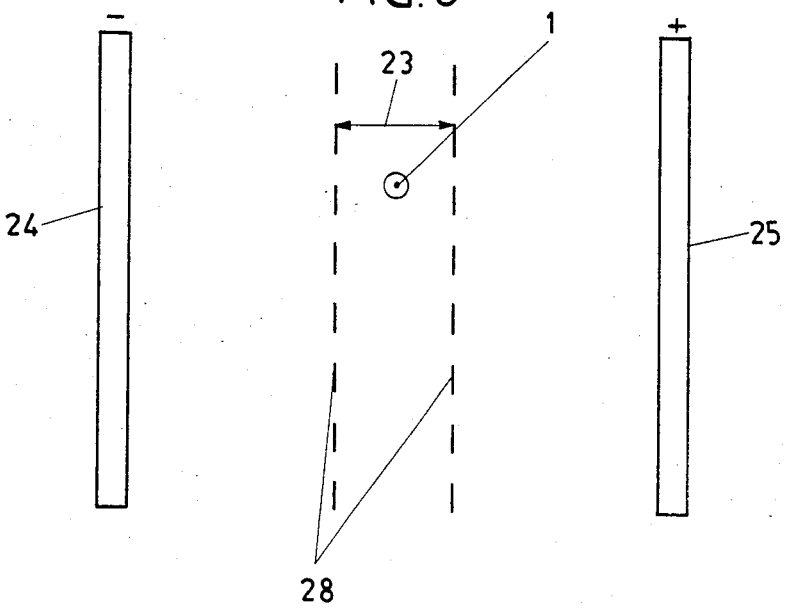
FIG. 8 is a schematic representation of an electrofilter with symmetrically functioning bipolar ion sources and a neutralization zone limited in extent by means of baffle plates.

FIG. 8 shows schematically an electrofilter with symmetrically acting bipolar ion sources, whereby the extent of the neutralization zone is limited laterally by baffle plates. The central neutralization zone 23 is separated laterally from the adjacent regions by baffle plates 28 in the form of meshes, grids or perforated or segmented metal flow deflectors.

Figure 9:
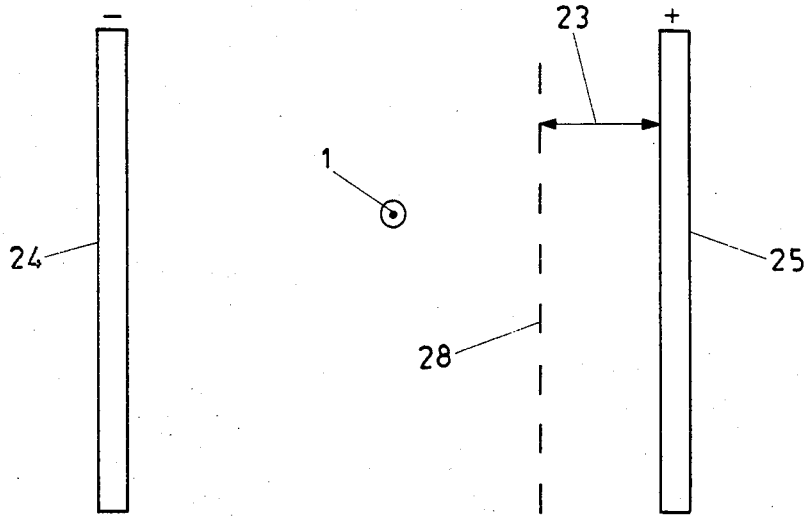
FIG. 9 is a schematic representation of an electrofilter with asymmetrically functioning bipolar ion sources and a neutralization zone limited in extent on one side by a baffle plate and on the other by an ion source.

FIG. 9 is a schematic representation of an electrofilter with asymmetrically acting bipolar ion sources. Only one baffle plate 28 is provided. Practically, the neutralization zone is formed by the region between the latter and the positive ion source 25, which also acts as the positive field electrode.

Figure 10:
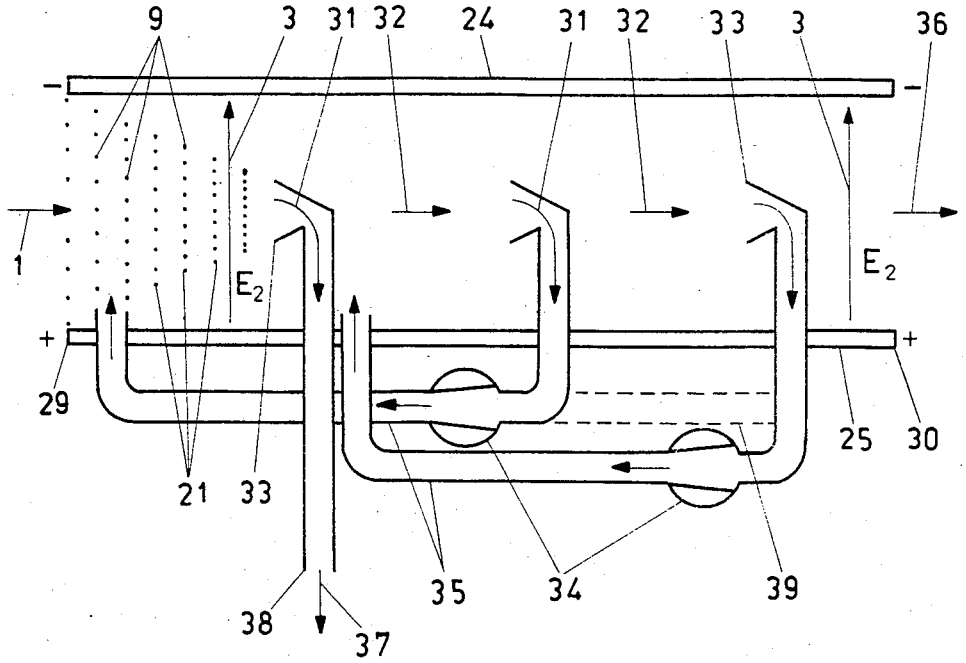
FIG. 10 is a schematic longitudinal cross-sectional through a multistage device for the electrical removal of particles with recycling of partial gas streams and both constant electrode spacing as well as constant separation voltage.

FIG. 10 shows schematically a longitudinal cross-sectional top view through a multistage device for electrical removal of particles with recycling of partial gas streams while maintaining a constant electrode spacing as well as a constant separation voltage. Seen from above, the particle-laden gas stream (untreated gas stream) 1 enters the electrofilter from the left-hand side (inlet 29). The ionization sources 24 and 25 in conjunction with the electric field 3 ($E_2$) result in electrical charging of at least a fraction of the particles (9 and 21) in a first stage and a concentration of these particles toward the center (i.e., due to electric field 3, vector $E_2$). A means 33 for the separation and diversion of a particle-enriched partial gas stream 31 is provided at the end of this stage, shown here as a "funnel". The partial gas stream 31 of the first stage, which is loaded with particles, is diverted off from the particle-depleted partial gas stream 32 and withdrawn at outlet 38 from the cleaning system. In a second stage and in a third stage the remaining partial gas streams 32 are successively cleaned further in an analgous manner. For the sake of clarity, the particles 9 and 21 of the first stage are not shown with respect to the second and third stages. The corresponding partial gas streams 31 are recycled to the previous stage by way of the fan 34 and the return line 35, as indicated by the corresponding arrows. An alternative return line 39 is indicated by the dotted line. The remaining cleaned gas stream 36 leaves the electrofilter through outlet 30. All remaining reference numbers and symbols can be taken from the previous figures.

Figure 11:
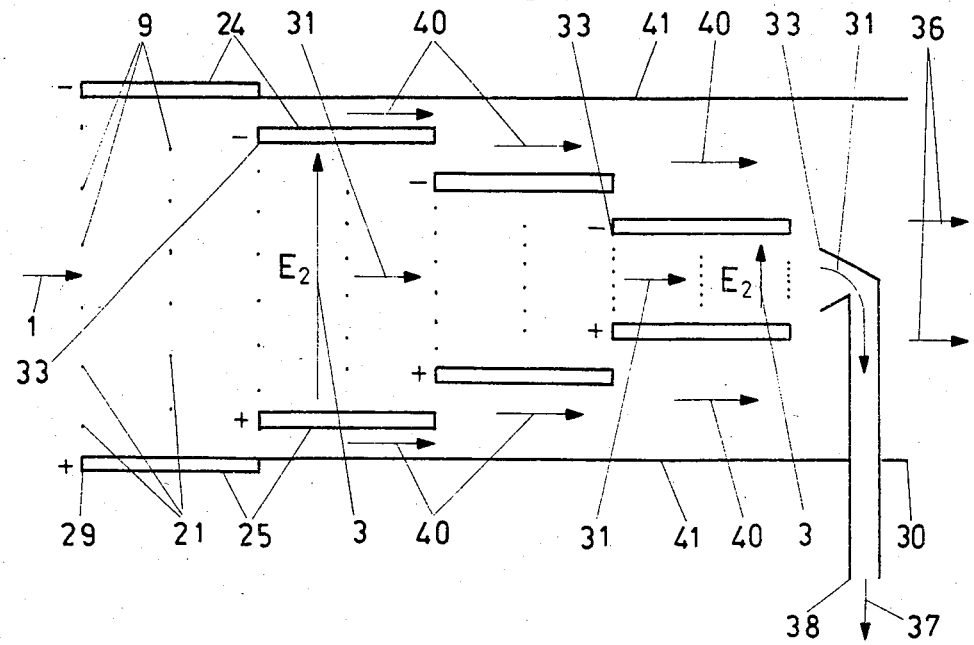
FIG. 11 is a schematic longitudinal cross-sectional view through a multistage device for electrical removal of particles with stepwise decreasing electrode spacing and differing separation voltages.

FIG. 11 is a schematic representation of a longitudinal cross-sectional view through a multistage device for the electrical removal of particles with stepwise decreasing electrode spacing and correspondingly differing separation voltages, which maintain nearly constant field strength $E_2$. Alternatively, the potential applied to electrodes 24, 25 can be maintained constant whereby a variable field strength is obtained between successive electrode pairs 24, 25. The untreated gas stream 1 loaded with particles enters the device from the left (inlet 29), is ionized by the ion sources 24 and 25 and electrically charged in a bipolar manner. The corresponding electric field 3 (vector $E_2$) forces the charged particles 9 and 21 progressively towards the center. This concentration is illustrated in the figure by the pointwise representation of the particles 9 and 21. At the end of the first stage, partial streams of cleaned gas 40 are branched off in the vicinity of the ion sources 24 and 25, whereby the laterally displaced leading edges of the ion sources 24 and 25 of the second stage signify the means 33 for the separation and diversion of the particle-enriched partial gas stream 31—here towards the center. Each stage successively decreases the cross-section of the particle-enriched partial gas stream 31 and increases that of the particle-depleted partial gas stream, the latter now becoming a fraction of the partial stream of cleaned gas 40. At the end of the final stage the remaining gas stream 37 maximally loaded with particles is diverted off and withdrawn at 38. Numeral 41 designates a neutral boundary wall for the partial stream of cleaned gas 40. The remaining reference numbers and symbols correspond to those in FIG. 10.

Figure 12:
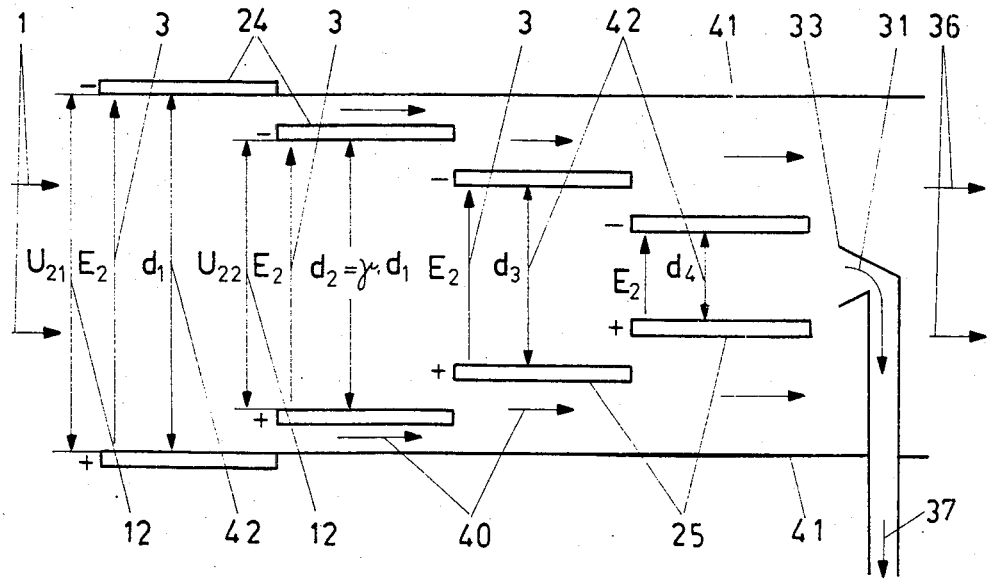
FIG. 12 is a schematic longitudinal cross-sectional view of a multistage device according to FIG. 11, with preferred geometric configuration of the electrodes.

FIG. 12 is a longitudinal cross-sectional view through a multistage device according to FIG. 11 represented schematically, whereby the electrodes indicate a preferred geometric configuration. Provided the electric field strength 3 (vector $E_2$) has the same constant value in all stages, the voltage 12 ($U_{21}$; $U_{22}$; $U_{23}$ . . . ) as well as vertical spacing 42 ($d_1$; $d_2$; $d_3$ . . . ) should preferably vary according to the following rule:

$$d_i = \gamma \cdot d_{i-1}$$

$$U_i = \gamma \cdot U_{i-1},$$

where $d_i$ = electrode spacing for stage i, $U_i$ = voltage between the electrodes of stage i, $\gamma$ = ratio of the width of the particle-enriched gas stream (~ width of the neutralization zone) to the corresponding electrode spacing.

The remaining reference numbers and symbols correspond exactly to those in FIG. 11.

Figure 13:
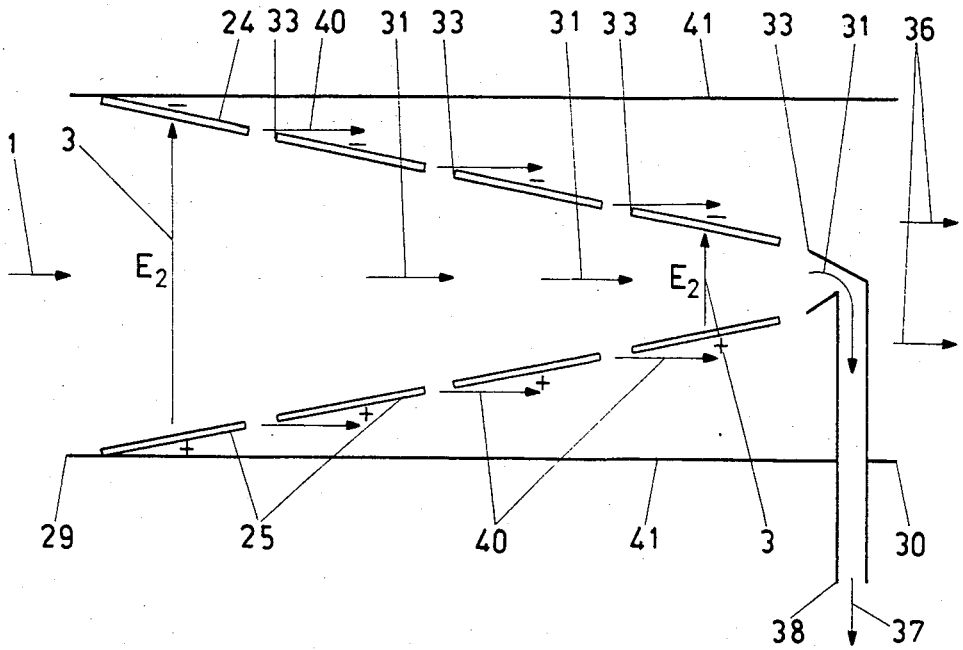
FIG. 13 is a schematic longitudinal cross-sectional view of a multistage device for electrical removal of particles with electrodes angled with respect to the flow direction, with continuously decreasing spacing and differing separation voltage.

FIG. 13 is a schematic representation of a cross-sectional longitudinal top view section, topview) through a multistage device for the removal of particles by electrical means with the electrodes and ionization sources angled with respect to the flow direction. The spacing between the ion sources 24 and 25 decreases continuously and progressively in the flow direction. Also the separation voltage is adjusted correspondingly. Between successive segments of the ion sources 24 or 25 there are gaps for diversion of a partial stream of cleaned gas 40. In the present example the ion sources 24 and 25 are each arranged approximately in planes. This need not necessarily be the case, however. Seen in cross-section, the ion sources 24 and 25 can also be arranged on curves, for example of an exponential function. Similarly, the surface in contact with the flow, representing an electrode at every stage, can be curved surfaces. The rest of the reference numbers and symbols correspond functionally to those in FIG. 11.

Figure 14:
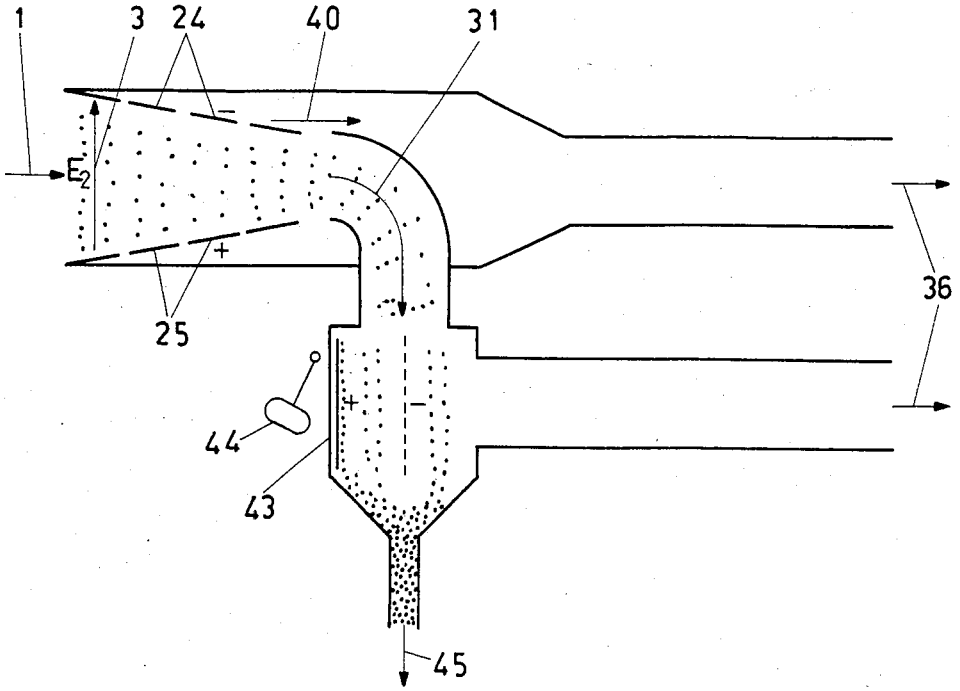
FIG. 14 is a schematic representation of the application of an electrical device for the removal of particles without a separation electrode as a prefilter for a conventional electrofilter.

FIG. 14 shows a schematic representation of the application of a new type of device for the electrical removal of particles without a separation electrode, for example, according to FIG. 11 or FIG. 13, as a prefilter for a conventional electrofilter. The untreated entering gas stream 1 is precleaned, whereby a partial stream of cleaned gas 40 is branched off whilst the cleaning of a particle-enriched partial gas stream 31, strongly reduced in quantity (e.g. to ½ or ⅓ of the untreated gas throughflow), is completed in a conventional electrofilter 43 provided with a separation electrode and a rapping device 44. Numeral 45 represents the outlet for the particles. Depending upon the purpose of use, the cleaned gas streams 36 can be collected or released into the atmosphere. The remaining reference numbers and symbols correspond to those in previous figures.

Figure 15:
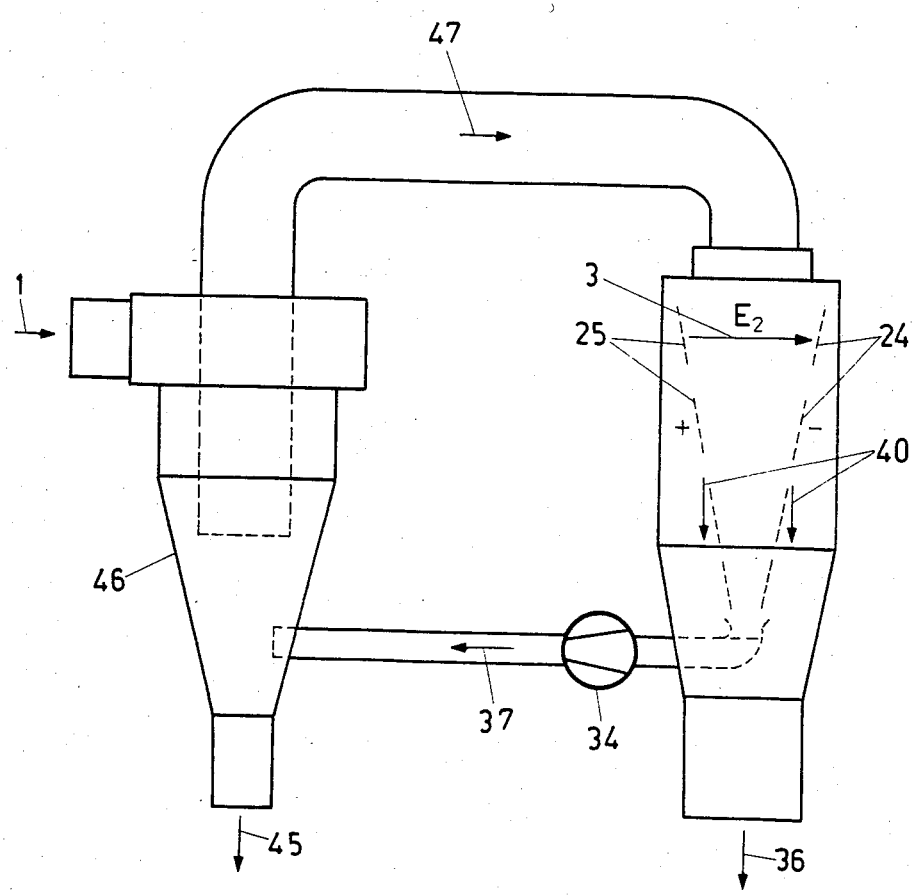
FIG. 15 is a schematic representation of an electrical device for the removal of particles without a separation electrode and with a cyclone both as a prefilter and for the withdrawal of the particles.

FIG. 15 represents schematically a new type of device for the electrical removal of particles without a separation electrode and with a cyclone acting both as a prefilter and for the withdrawal of particles. The untreated gas stream 1 loaded with particles enters the cyclone 46 where it is precleaned. The precleaned gas stream 47 leaves the cyclone 46 and the cleaning process is completed in a new type of electrofilter without a separation electrode (e.g. according to FIG. 13). The partial streams of cleaned gas 40 are separated off and leave the electrofilter together as the cleaned gas stream 36. The remaining gas stream 37 maximally loaded with particles is returned by means of a fan 34 in the lower part of the cyclone 46 where its particles, together with the primary separated particles, are discharged at 45. If necessary for improving the degree of cleaning, an additional cyclone can be provided between the fan 34 and the cyclone 46. All remaining reference numbers and symbols are evident from previous figures.

Figure 16:
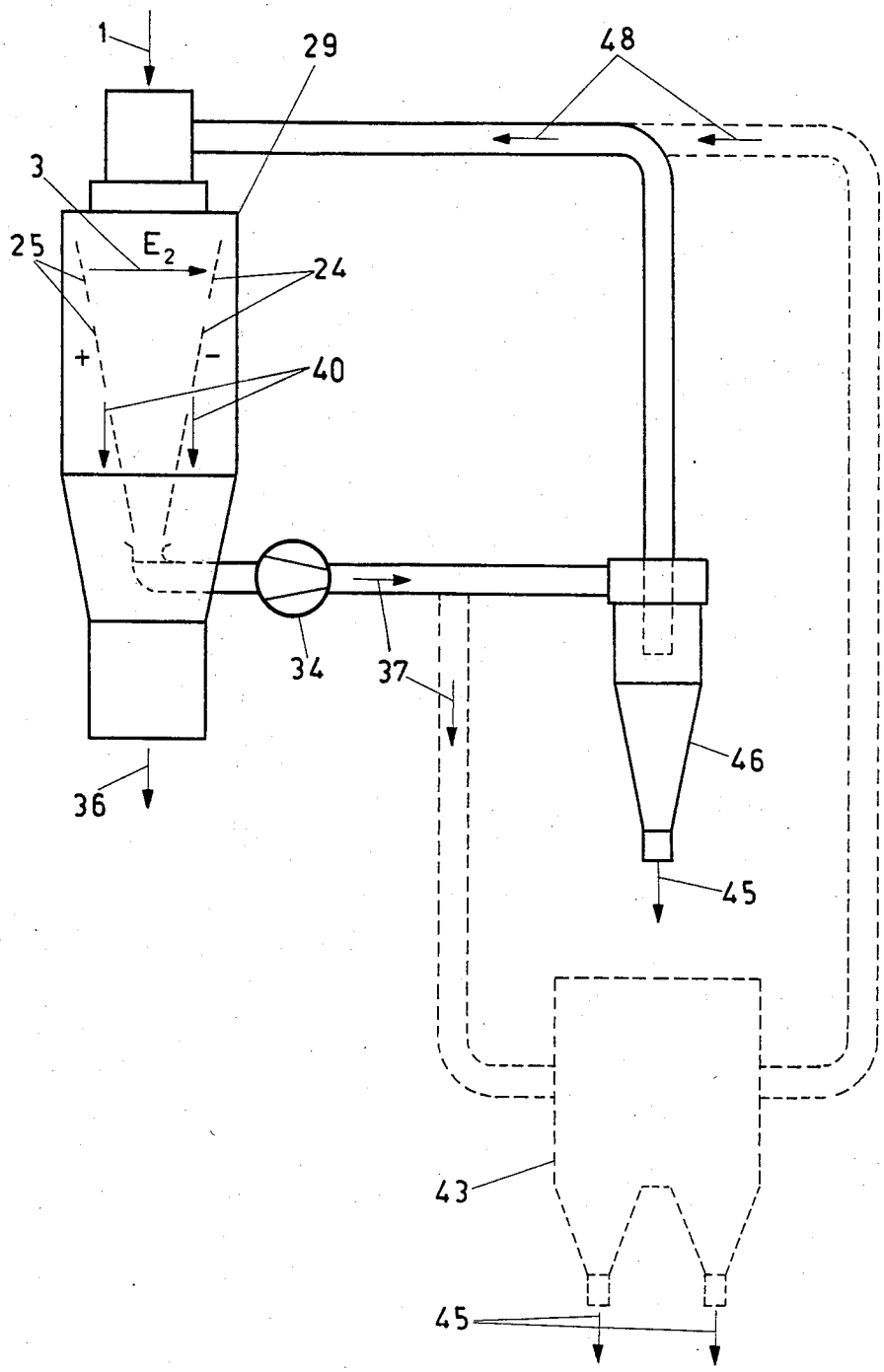
FIG. 16 is a schematic representation of an electrical device for the removal of particles without a separation electrode and with a cyclone or a conventional electrofilter for the withdrawal of the particles.

FIG. 16 is a schematic representation of a new type of device for the electrical removal of particles without a separation electrode and with a cyclone or a conventional electrofilter for the discharge of particles. The untreated gas stream 1 enters the new type of electrofilter at the same time as the cleaned gas stream 36 leaves. The remaining gas stream 37 maximally loaded with particles is fed into a cyclone 46 by way of a fan 34 where the particles are discharged at 45. Instead of a cyclone 46 a conventional electrofilter 43 with outlet 45 can also be used for this purpose, as indicated in the drawing with a dashed line. The partial gas stream 48 is returned to the feed point (inlet to the new type of electrofilter) and mixed with the untreated gas stream 1.

All remaining reference numbers and symbols can be inferred from the previous figures.

Figure 17:
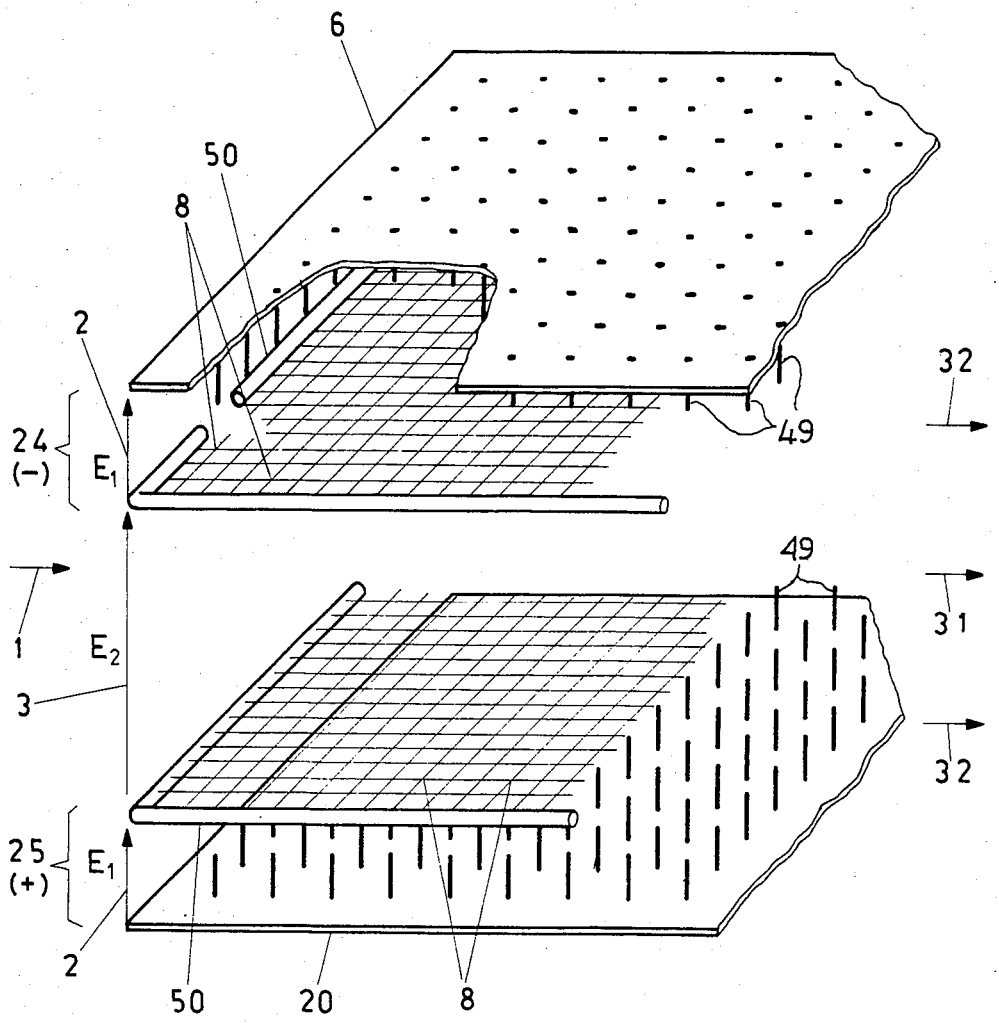
FIG. 17 is a perspective representation of an electrofilter with ionization regions limited in extent by needle electrodes and metal grids and with a neutralization zone in between, FIG. 18 is a schematic representation of an electrofilter according to FIGS. 11 and 17 with the associated high-voltage power supplies.

FIG. 17 is a perspective representation of an electrofilter with ionization regions and an intervening neutralization zone limited by needle electrodes and metal grids. The observer views from above into the main elements arranged in vertical planes, so that the plane of the drawing represents the cross section (topview). The untreated gas stream 1 loaded with particles in suspension enters from the left horizontally into the device. The particle-enriched partial gas stream 31 is located in the central area of the device and leaves it horizontally at the right edge of the figure. The particle-depleted partial gas strams 32 adjacent to and on either side of the partial gas stream 31 are conveyed further parallel to the former also horizontally. The negative corona electrode 6 and the positive corona electrode 20 are each designed as a metallic, vertically oriented flat plate provided with wire pins pointed at their protruding ends 49 located perpendicular to the plates. The supplementary electrodes 8 located on each side in planes parallel to 6 and 20 are designed as metal grids each supported by a frame 50. It is advantageous for this frame 50 to consist of a metal tube. With this arrangement an ionization region is formed on both the positive as well as the negative side. The electric field 2 (ionization field strength $E_1$) exists in this region. The totality of the construction elements on each side represents the corresponding negative and positive ion sources 24 and 25, respectively. The electric field 3 (separation field strength $E_2$) exists in the separation region where primarily the charging and migration as well as the coagulation of the particles occur.

Figure 18:
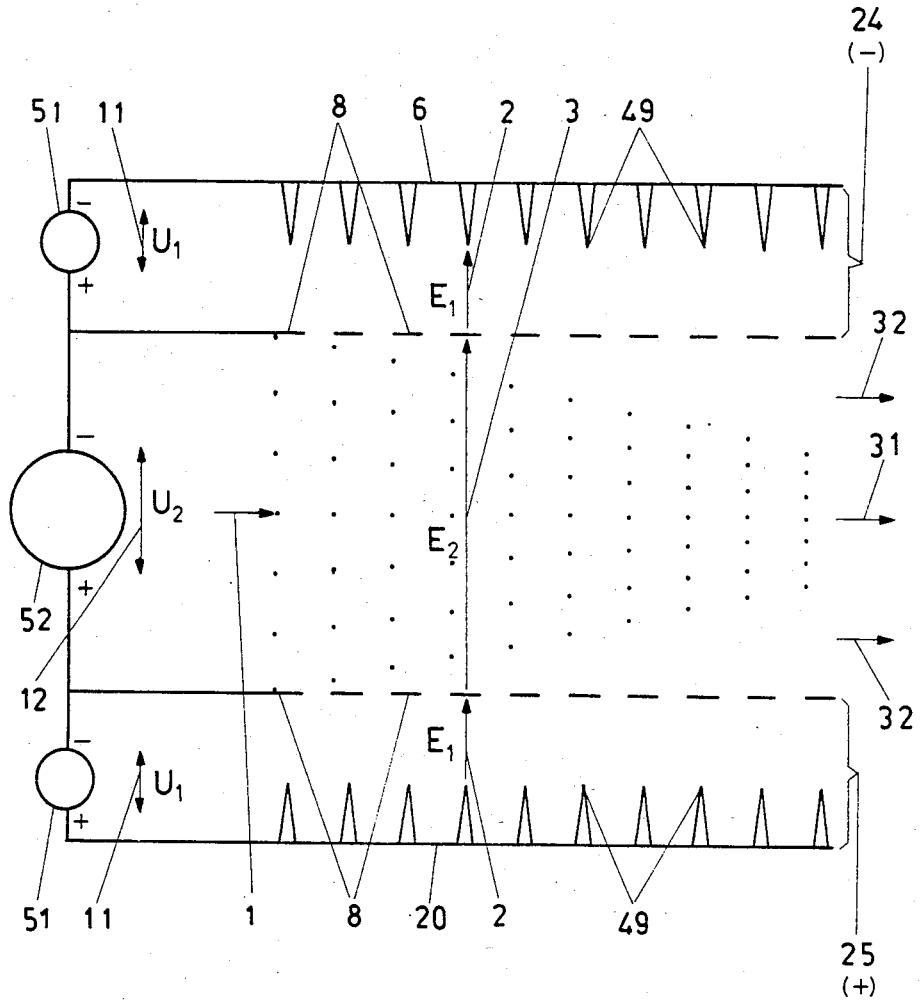

FIG. 18 is a schematic representation of an electrofilter according to

FIG. 11 (considering only a single stage) or FIG. 17 with the associated high-voltage power supply. Numeral 51 designates a high-voltage source to provide the ionization voltage 11 (in the present case represented by the direct voltage vector $U_1$). The pointed wire pins 49 of the corona electrode 6 of the negative ion source 24 are negative with respect to the supplementary electrode 8, and those of the corona electrode 20 of the positive ion source 25 positive with respect to the other corresponding supplementary electrode 8. Numeral 52 designates a high-voltage source for supplying the supplementary electrode 8 with the separation voltage 12 (in the present case represented by the direct voltage vector $U_2$). The electric fields 2 and 3 associated with voltages 11 and 12 correspond exactly to those in FIGS. 11 and 17. The gas streams 1, 31 and 32 are indicated by arrows pointing from left to right. The particles are represented by rows of dots which become successively more closely packed in the flow direction. The rest of the figure is self-explanatory.

DESCRIPTION OF THE PREFERRED EMBODIMENT

See FIGS. 11, 17 and 18.

A device for electrical removal of particles was constructed according to FIG. 17. Pointed metal wire pins 49 with an axial length of 20 mm were inserted and fixed into the plate-shaped electrodes 6 and 20 each of which is formed from a metal sheet. The pins had a diameter of 1.5 mm and were arranged in a square array with a separation (distance between pin centers) of 20 mm. Each of the supplementary electrodes 8 consisted of a metal grid (wire mesh) of mesh size 0.7 mm wire separation 1.0 mm) with a wire diameter of 0.3 mm. This wire mesh was stretched between and supported by a rectangular frame 50 made of a tube of 15 mm outer diameter. In the present case the wire mesh was welded on the side of the frame 50 facing the gas stream 1, so that in the region between the supplementary electrodes 8 there was a strongly homogeneous electric field 3 (uniform field strength $E_2$). The spacing between the supplementary electrodes 8 (inside width) was 400 mm with a depth transverse to the flow direction of 800 mm and an axial length in the flow direction of 2000 mm. The distance of the points of the wire pins 49 from the plane of the supplementary electrode 8 was 20 mm.

The voltage 11 (direct voltage $U_1$) of the high-voltage sources 51 for ionization was 20 kV, so that an average ionization field strength $E_1$ was achieved in the region of the electric field 2, which at 20 kV/cm was clearly in excess of the value necessary for the corona effect to occur. The total separation voltage 12 (direct voltage $U_2$) of the high-voltage source 52 was 120 kV. In the present case it was provided by two series-connected high-voltage devices each of 60 kV, whereby the center, i.e., one of each of the opposite poles, was grounded. The uniform field strength in the separation and concentration region reached the value of 3 kV/cm.

In the device an untreated gas stream 1 loaded with particles and was blown into the separation region with an average flow velocity of 2 m/s. The particulatle matter consisted of particles of tobacco smoke with a diameter of $<1$ μm and chalk dust with an average particle diameter of ca. 30 μm. The total loading of the gas stream 1 with particles in suspension was 20 g/m$^3$.

It could be observed that in the course of their longitudinal passage through the device the particles were forced to migrate transversely toward the central neutralization zone (cf. zone 23 in FIG. 7). The particles were propelled toward the center so that at the outlet of the electrofilter a concentration of the particles in a zone approximately 100 mm in width could be observed (partial gas stream 31). On either side of this particle-laden zone there were practically particle-free layers (partial gas streams 32) each about 150 mm wide. The remaining particle content of the cleaned gas stream was less than 0.1 g/m$^3$. It could further be noted that most of the fine tobacco particles were deposited on the coarser chalk particles.

It should be understood that the invention is not limited to the particular embodiments shown and described herein, but that the concept of the device for particle removal and basically all procedural steps and design principles mentioned in the figure descriptions (FIG. 1 to 18) can be combined in accordance with operating requirements. The key concept of the invention consists of the fact that with the greatest possible freedom of type and configuration of the ion sources/field electrodes the highest possible and most homogeneous electric field is achieved in order to give the charged particles a high migration velocity.

Advantages of the new procedure and new devices are:

High degree of separation of the particles, small filter size, in particular greatly reduced dimensions in the flow direction compared with conventional filters, High energy power density, Low specific lower requirements, and High operating reliability (freedom from undesirable breakdown and spark-over at the electrodes).

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A process for the removal of solid or liquid particles in suspension in a gas stream loaded with said particles and having a flow direction and cross-section, comprising the steps of:

charging the suspended particles in a bipolar manner approximately half positively and half negatively;

applying a homogeneous electric field independent of said charging step transverse to the flow direction to produce a migration of the charged suspended particles so that the charged suspended particles move toward and concentrate in a neutralization zone spatially separate from the charging of the suspended particles where said charged suspended particles agglomerate and coagulate and at least partially neutralize their respective charges, whereby both suspended particle-enriched and suspended particle-depleted partial gas streams are formed; and separating the suspended particle-enriched and suspended particle-depleted partial gas streams from each other.

2. A process according to claim 1, further comprising the step of:

applying said electric field such that said neutralization zone of the gas stream is established toward the center of the flow cross-section.

3. A process according to claim 1, further comprising the step of:

using a common source for simultaneously producing the charged particles and generating said electric field.

4. A process according to claim 1, further comprising the step of:

generating the charged particles by means of corona effects under the influence of an ionizing electric field.

5. A process according to claim 1, further comprising the step of:

separately introducing a stream of another supplementary gas in the charging step.

6. A process according to claim 1, wherein said separating step comprises:

diverting and withdrawing the particle-enriched partial gas stream from the particle-depleted partial gas stream and subjecting the particle-enriched partial gas stream to a further particle-removal process.

7. A process according to claim 6, further comprising the steps of: withdrawing the particle-enriched partial gas stream in several stages;

returning the withdrawn particle-enriched partial gas stream from one stage to the gas stream at one of the previous stages; and withdrawing at least one of the particle-enriched partial gas streams from at least a selected one of the previous stages without returning the particles withdrawn from said selected stage to the gas stream.

8. A process according to claim 6, further comprising the steps of:

precleaning the gas stream based on centrifugal separation in a cyclone; and feeding the particle-enriched partial gas stream to a particle outlet of the cyclone.

9. A process according to claim 6, further comprising the steps of:

removing the particles contained in the particle-enriched partial gas stream according to the principles of centrifugal separation or electrical separation and feeding the partially cleaned fraction upstream back into the supplied gas stream for further removing of particles therefrom.

10. A process according to claim 1, further comprising the steps of:

successively branching off from the gas stream, observed in the flow direction, the suspended particle-depleted partial gas stream;

collecting and supplying the successively branched off suspended particle-depleted partial stream;

feeding the suspended particle-enriched partial gas stream after said collecting and supplying step into a final isolated particle-removal device; and separating and withdrawing said particles from said suspended particle-enriched partial gas stream.

11. A process according to claim 10, wherein said step of successively branching off comprises:

branching-off the particle-depleted partial gas stream stepwise in cascade fashion.

12. A device for the removal of solid or liquid particles in suspension in a gas stream having a flow direction, comprising:

means for charging approximately one half of the particles suspended in the gas stream positively, and the other half negatively;

means for applying a homogeneous electric field unaffected by and independent of said means for charging transverse to the flow direction of the gas stream including the charged particles so that in a neutralization zone spatially separate from said means for charging a particle enrichment in a partial gas stream occurs and outside the neutralization zone an associated partial stream of cleaned gas occurs; and means for branching off and withdrawal of a selected one of the particle-enriched partial gas stream and the associated partial stream of cleaned gas.

13. A device according to claim 12, wherein said electric field applying means comprises similarly shaped metallic electrodes.

14. A device according to claim 13, wherein the metallic electrodes are flat plates.

15. A device according of claim 14, wherein the metallic flat plates are made of metal mesh.

16. A device according to claim 13, wherein the metallic electrodes are of cylindrical shape.

17. A device according to claim 13, wherein said branching off means comprises:

a separate particle-removal device; and a funnel-shaped component connected to a suction line for connection to said separate particle-removal device.

18. A device according to claim 17, wherein said separate particle-removal device comprises:

a centrifugal cleaner in the form of a cyclone.

19. A device according to claim 17, wherein said separate particle-removal device comprises:

an electrical particle remover in the form of an electrofilter.

20. A device according to claim 13, further cormprising:

baffle plates disposed between said electrodes for limiting the neutralization zone transverse to the gas stream.

21. A device according to claim 12, wherein the charging means comprises:

an electrode for the generation of an electric field; and an ionization device for producing a corona discharge.

22. A device according to claim 21, wherein said ionization device comprises:

an electrode selected from the group consisting of needle or wire electrodes with the same or differing radii of curvature and cap-shaped electrodes embedded in an insulating body serving as a base plate.

23. A device according to claim 12, wherein said charging means comprises:

separately supplied streams of other supplementary gases.

24. A device according to claim 12, wherein said branching off means comprises:

a funnel-shaped component connected to a suction line connected to a return line for return of the particle-enriched gas stream to the charging means.

25. A device according to claim 12, wherein:

said means for charging comprises plural cascaded ion sources;

said means for applying a homogeneous electric field comprises plural cascaded opposed electrode pairs with the electrodes of each pair having a potential applied thereto, the opposed electrode pairs spaced apart to define an opening through which said gas stream flows; and said cascaded ion sources are arranged in association with respective of said cascaded opposed electrode pairs to form plural cascaded stages in which the openings defined by the opposed electrode pairs of the cascaded stages successively have a decreasing cross-section.

26. A device according to claim 25, wherein said plural cascaded stages comprise:

a number n of said ion sources and said respective opposed electrode pairs, with the electrodes of said electrode pairs having a stepwise decreasing spacing $d_i$ therebetween and having an electrode voltage $U_i$ applied across each electrode pair, such that $d_i$ and $U_i$ satisfy the following relationships:

$$d_i=\gamma \cdot d_{i-1}$$

$$U_i=\gamma \cdot U_{i-1},$$

wherein:

i=any one of said n stages, $d_i$=electrode spacing for stage i, $U_i$=voltage of stage i, $\gamma$=ratio of the width of the particle-enriched gas stream to the corresponding electrode spacing.

27. A device according to claim 12, wherein said means for charging and said transverse electric field applying means comprise:

segment-like shaped ion source and electrode pairs defining a channel having a progressive continuous decrease in cross-section.

* * * * *